US008534939B2

(12) United States Patent
Yamaguchi et al.

(10) Patent No.: US 8,534,939 B2
(45) Date of Patent: Sep. 17, 2013

(54) TAPE PRINTING APPARATUS WITH TAPE CASSETTE IDENTIFYING UNIT

(75) Inventors: Koshiro Yamaguchi, Kakamigahara (JP); Teruo Imamaki, Nisshin (JP); Akira Sago, Seto (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 285 days.

(21) Appl. No.: 13/025,667

(22) Filed: Feb. 11, 2011

(65) Prior Publication Data

US 2011/0135373 A1 Jun. 9, 2011

Related U.S. Application Data

(63) Continuation-in-part of application No. PCT/JP2009/061588, filed on Jun. 25, 2009.

(30) Foreign Application Priority Data

Oct. 22, 2008 (JP) ..... 2008-271939

(51) Int. Cl.
*B41J 29/38* (2006.01)
*B41J 11/70* (2006.01)

(52) U.S. Cl.
USPC ..... 400/76; 400/621

(58) Field of Classification Search
CPC ..... B41J 3/36; B41J 11/703; B41J 29/38
USPC ..... 400/76, 613, 621
See application file for complete search history.

(56) References Cited

U.S. PATENT DOCUMENTS

| | | | | |
|---|---|---|---|---|
| 5,536,092 | A | 7/1996 | Yamaguchi | |
| 5,636,926 | A | 6/1997 | Yamaguchi | |
| 5,681,123 | A | 10/1997 | Yamaguchi | |
| 5,730,536 | A | 3/1998 | Yamaguchi | |
| 6,644,802 | B2 | 11/2003 | Minowa | |
| 7,578,332 | B2 | 8/2009 | Murata et al. | |
| 2006/0151118 | A1 | 7/2006 | Murata et al. | |
| 2006/0222431 | A1 * | 10/2006 | Kato et al. | 400/621 |
| 2011/0008090 | A1 * | 1/2011 | Yamaguchi et al. | 400/613 |

FOREIGN PATENT DOCUMENTS

| | | |
|---|---|---|
| CN | 1796238 | 7/2006 |
| JP | 6-305223 | 11/1994 |
| JP | 6-328813 | 11/1994 |
| JP | 7-068814 | 3/1995 |

(Continued)

OTHER PUBLICATIONS

PCT/JP2009/061588, International Preliminary Report on Patentability, dated May 26, 2011.

(Continued)

*Primary Examiner* — Daniel J Colilla
(74) *Attorney, Agent, or Firm* — McCarter & English, LLP

(57) ABSTRACT

A CPU detects whether or not a type of a tape cassette housed in a cassette housing portion is a stripped-tape accommodating cassette that creates an after-printed tape with a separator being peeled off from its adhesive layer. In case the CPU detects that the type of the tape cassette in the cassette housing portion is a stripped-tape accommodating cassette that creates an after-printed tape with a separator being peeled off from its adhesive layer, only one after-printed tape in predetermined length with a separator being peeled off from its adhesive layer is made subject to tape printing, and consequently conveyed to a cutting point, whereby tape printing is terminated.

4 Claims, 9 Drawing Sheets

(56) References Cited

FOREIGN PATENT DOCUMENTS

| | | | | |
|---|---|---|---|---|
| JP | 7-205529 | | | 8/1995 |
| JP | 9-327906 | | | 12/1997 |
| JP | 10-166629 | | | 6/1998 |
| JP | 2001270647 | A | * | 10/2001 |
| JP | 2002-210943 | | | 7/2002 |
| JP | 2004-189304 | | | 7/2004 |
| JP | 2005247449 | A | * | 9/2005 |
| JP | 2007-185774 | | | 7/2007 |
| JP | 2007-216515 | | | 8/2007 |
| JP | 2010100377 | A | * | 5/2010 |

OTHER PUBLICATIONS

Chinese Office Action issued in Chinese Application No. 200980136626.2 on Apr. 28, 2013.

* cited by examiner

TAPE PRINTING APPARATUS WITH TAPE CASSETTE IDENTIFYING UNIT

CROSS-REFERENCE TO RELATED APPLICATIONS

The present application is a continuation-in-part application based upon and claims the benefit of the prior PCT International Patent Application No. PCT/2009/061588 filed on Jun. 25, 2009, the disclosure of which is herein incorporated by reference in its entirety.

TECHNICAL FIELD

The disclosure relates to a tape printing apparatus that replaceably houses a tape cassette accommodating a long-length tape inside.

BACKGROUND

There has conventionally been proposed a tape printing apparatus that replaceably houses a tape cassette accommodating a set of a receptor type printing tape and an ink ribbon inside wherein its printing unit such as thermal head or the like carries out printing on an ink-ribbon-side surface of the printing tape, then the after-printed printing tape is cut off by its cutter unit and ejected.

SUMMARY

In the disclosure, the object is to provide a tape printing apparatus capable of avoiding a situation that printing tapes with uncovered adhesive surfaces get adhered overlapping with one another near a label ejecting port, given that printing tapes are conveyed in a state that their respective separators are peeled from the printing tapes inside the tape cassette.

A tape printing apparatus, directed to the disclosure for achieving the above object, comprises: a cassette housing portion that replaceably houses a tape cassette; a tape conveying unit for conveying a tape that is long and accommodated inside in the tape cassette; a printing unit for carrying out printing on the tape; and a cutter unit that cuts off a tape, wherein the tape printing apparatus further comprises: a printing-information obtaining unit that obtains printing information consisting of printing data to be printed out on the tape and a to-be-created number of labels by printing out the printing data on the tape; a type detecting unit that detects a type of a tape cassette housed in the cassette housing portion; a type identifying unit that identifies whether or not the type of the tape cassette detected by the type detecting unit is a stripped-tape accommodating cassette that ejects a tape in a state that a separator is peeled off from an adhesive layer of the tape, the adhesive layer being formed on one surface of the tape; and a printing control unit that controls the printing unit to print out the printing data only once, thereafter convey the tape to a cutting point for the cutter unit and stop conveyance of the tape so as to terminate printing, in case the type of the tape cassette housed in the cassette housing portion is identified as the stripped-tape accommodating cassette.

DETAILED DESCRIPTION

There will be described on a tape printing apparatus embodying the disclosure in detail based on an embodiment by referring to drawings.

First, there will be described on the schematic configuration of a tape printing apparatus 1 directed to the present embodiment by referring to FIG. 1 through FIG. 3.

Figure 1:
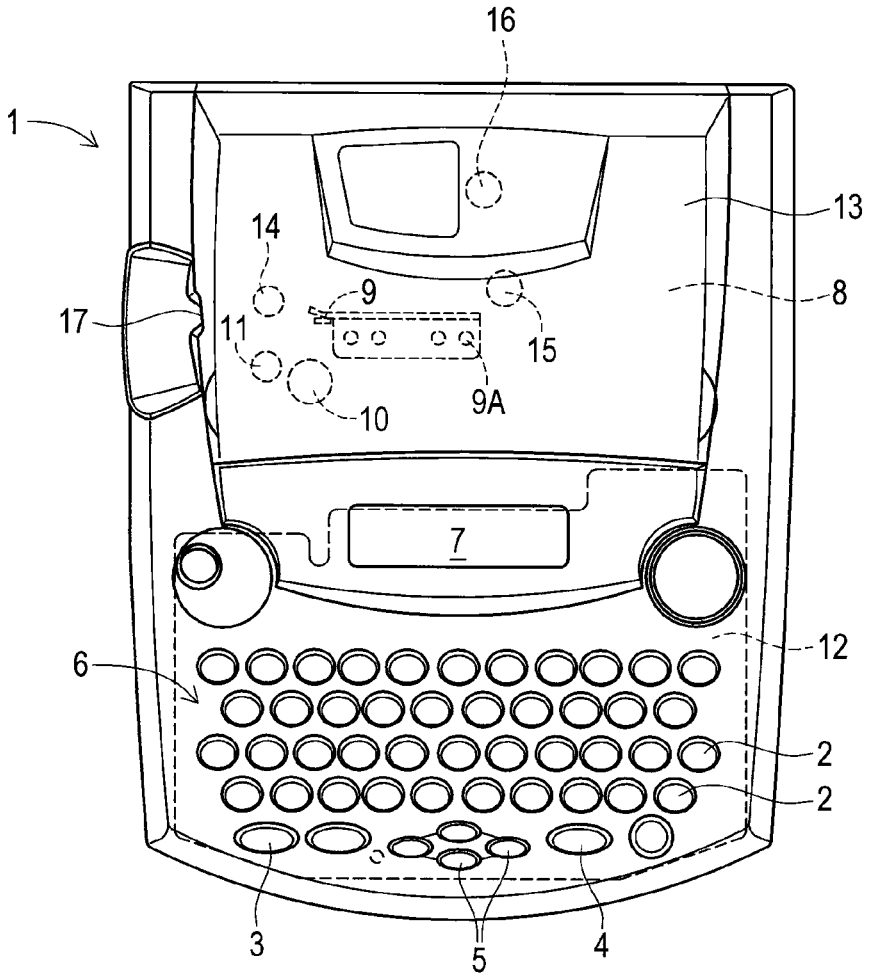
FIG. 1 is a plain view of a tape printing apparatus directed to an embodiment.
Figure 2:
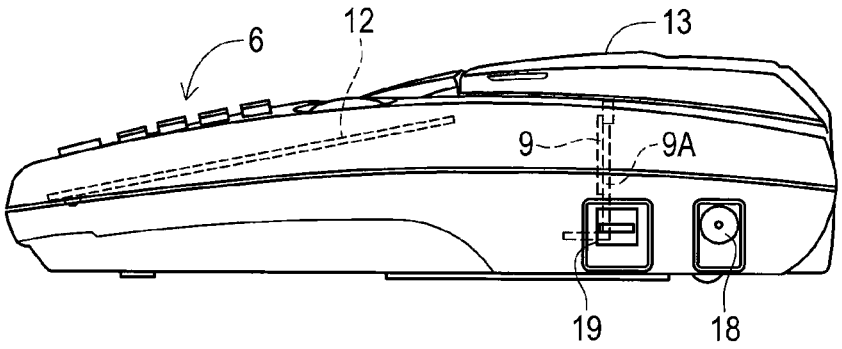
FIG. 2 is a right side view of the tape printing apparatus.
Figure 3:
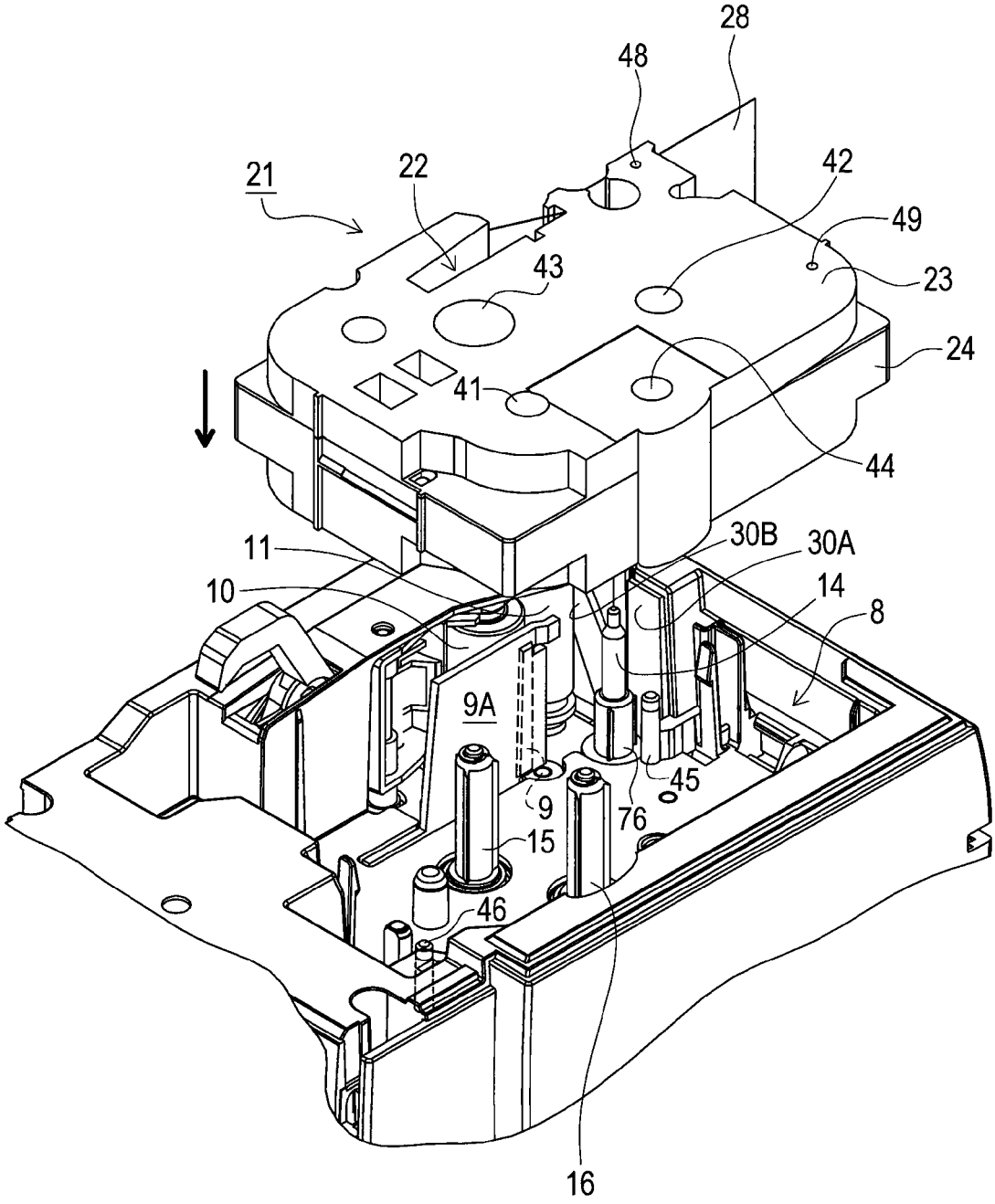
FIG. 3 is a main-part-enlarged perspective view for illustrating a state that a stripped-tape accommodating cassette is to be placed in a cassette housing portion of the tape printing apparatus.

As shown in FIG. 1 through FIG. 3, the tape printing apparatus 1 directed to the present embodiment includes a keyboard 6, a cassette housing portion 8 for housing a stripped-tape accommodating cassette 21 or a normal-tape accommodating cassette 81 to be described later (refer to FIG. 8) and a housing cover 13 for covering the cassette housing portion 8. The keyboard 6 includes: letter input keys 2 for commanding to create texts in a form of document data; a print key 3 for commanding to print out texts etc.; a return key 4 for executing a line feeding instruction and various processing and for determining a choice from candidates; cursor keys 5 for moving a cursor up, down, left or right, the cursor being indicated in a liquid crystal display (LCD) 7 that indicates letters and characters across plural lines; and the like.

Figure 11:
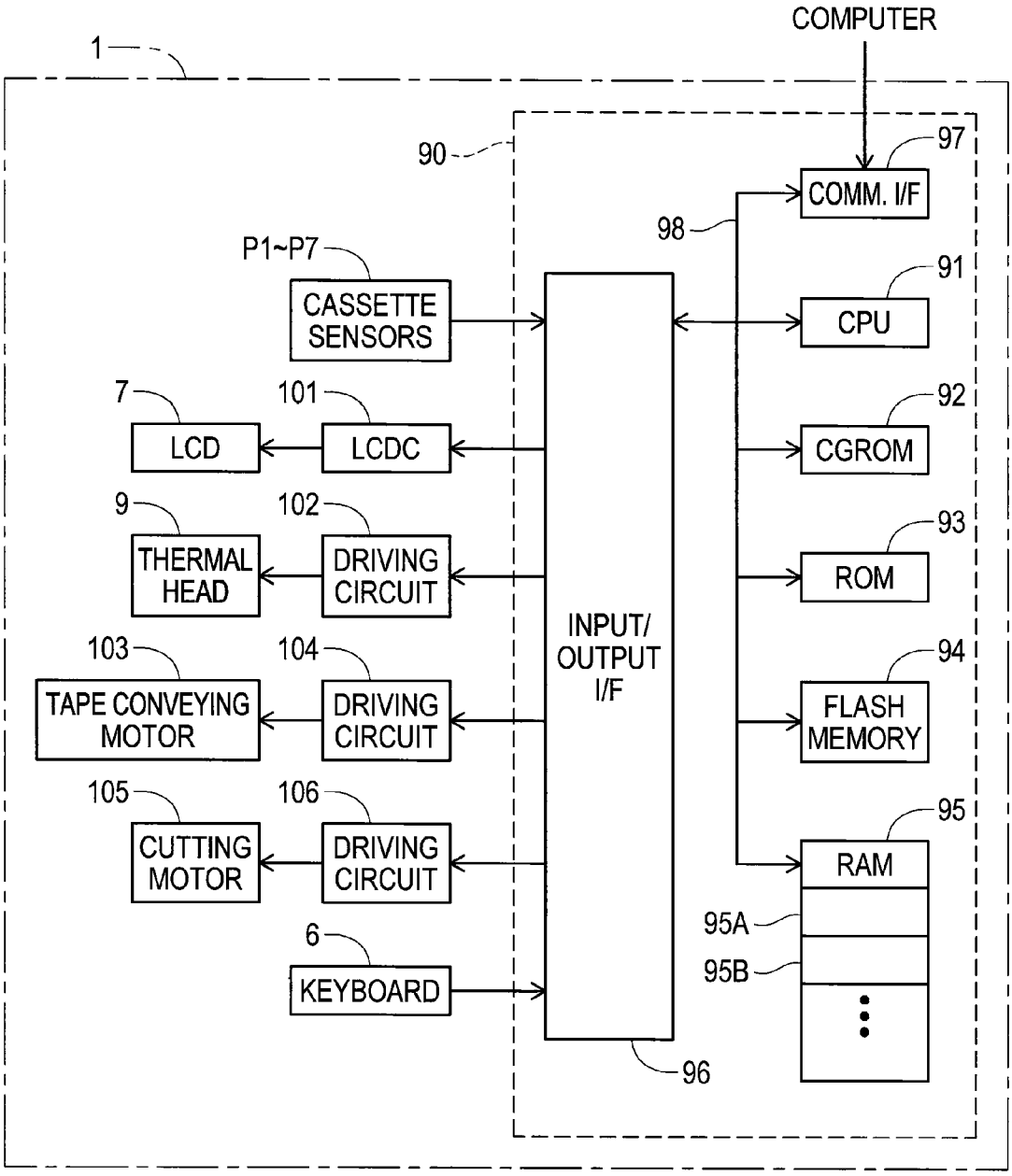
FIG. 11 is a circuit block diagram showing a main-part circuit configuration of the tape printing apparatus.

Beneath the keyboard 6, there is arranged a control board 12 that constitutes a control circuit unit 90 (refer to FIG. 11). At the left side of the cassette housing portion 8, there is formed a label ejecting port 17 for ejecting an after-printed printing tape from which a separator is peeled off as will be described later or an after-printed printing tape with a separator adhered thereon. Further, at the right side of the cassette housing portion 8, there are arranged an adaptor inlet 18 to be connected to a power supply adaptor and a USB connector 19 to be connected to a USB cable for connecting to a not-shown personal computer.

In the cassette housing portion 8, there are arranged a thermal head 9, a platen roller 10 that faces the thermal head 9, a tape sub roller 11 arranged at a downstream side for the platen roller 10, a metallic tape-driving-roller shaft 14 that faces the tape sub roller 11, a ribbon-take-up shaft 15 that conveys an ink ribbon 52 (refer to FIG. 4) to be housed inside the stripped-tape accommodating cassette 21, a separator-take-up shaft 16 that takes up a separator 53D (refer to FIG. 4) that has been peeled off from a two-sided adhesive tape 53 (refer to FIG. 4) to be described later, etc.

The thermal head 9 is a flat plate that is substantially rectangular shaped when seen from front. Along the front left end of the thermal head 9, a predetermined number of heater elements R1-Rn (e.g., n is 128 or 256) are aligned. Further, there is arranged a radiator plate 9A that is made of plated sheet steel, stainless steel plate or the like and substantially quadrangular shaped when seen from front. The thermal head 9 is fixed to the front left end of the radiator plate 9A with adhesive or the like so that the alignment of the heater elements R1-Rn runs parallel to the left side of the radiator plate 9A. The said radiator plate 9A is fixed to the lower side of the cassette housing portion 8 with a screw or the like so that the alignment of the heater elements R1-Rn crosses at substantially right angle with respect to the conveying direction of the film tape 51 (refer to FIG. 4) at an opening 22 of the stripped-tape accommodating cassette 21.

Further, the ribbon-take-up shaft 15 is driven for rotation by proper driving mechanism originated from the tape conveying motor 103 (refer to FIG. 11) that consists of a stepping motor or the like. As will be described later, the ribbon-take-up shaft 15 is fitted into the ribbon-take-up spool 61 that is rotatably arranged inside the stripped-tape accommodating cassette 21 (refer to FIG. 4) and driven for rotation. Further, the tape-driving-roller shaft 14 is driven for rotation by proper transmission mechanism originated from the tape conveying motor 103. Specifically, the tape-driving-roller shaft 14 is fitted into an electrically-conductive resin tape conveying roller 63 (refer to FIG. 4) that is rotatably arranged inside the stripped-tape accommodating cassette 21 and driven for rotation. Still further, the separator-take-up shaft 16 is driven for rotation by proper transmission mechanism originated from the tape conveying motor 103. Specifically, the separator-take-up shaft 16 is fitted into a separator-take-up spool 62 (refer to FIG. 4) that is rotatably arranged inside the stripped-tape accommodating cassette 21 and driven for rotation.

Meanwhile, the separator-take-up shaft 16 may be driven for rotation by proper driving mechanism originated from a not-shown separator-take-up motor that consists of a stepping motor or the like that is furnished separately from the tape conveying motor 103. Thereby, even if stretch rate of an ink ribbon 52 and that of a separator 53D differ significantly, a separator 53D can be taken up reliably by synchronously driving the tape conveying motor 103 and the separator-take-up motor.

Further, as shown in FIG. 3, nearby a tape ejecting port 27 (refer to FIG. 4) of the stripped-tape accommodating cassette 21 as well as a tape ejecting port 83 (refer to FIG. 8) of a normal-tape accommodating cassette 81, a scissor-type cutter unit 30 is arranged so as to cut off an after-printed tape by predetermined length. The cutter unit 30 consists of a fixed blade 30A and a movable blade 30B wherein a cutting motor 105 serves to move the movable blade 30B toward the fixed blade 30A so as to cut off an after-printed tape.

On the bottom of the cassette housing portion 8, two positioning pins 45 and 46 are arranged upright with the same height. When the stripped-tape accommodating cassette 21 or the normal-tape accommodating cassette 81 is placed in the cassette housing portion 8, position of the stripped-tape accommodating cassette 21 or that of the normal-tape accommodating cassette 81 is properly fixed by the positioning pins 45 and 46 inside the cassette housing portion 8.

Next, there will be described on the schematic configuration of the stripped-tape accommodating cassette 21 by referring to FIG. 3 through FIG. 7. In the stripped-tape accommodating cassette 21, an after-printed printing tape 28 is created in a state that a separator 53D is peeled off therefrom.

Figure 4:
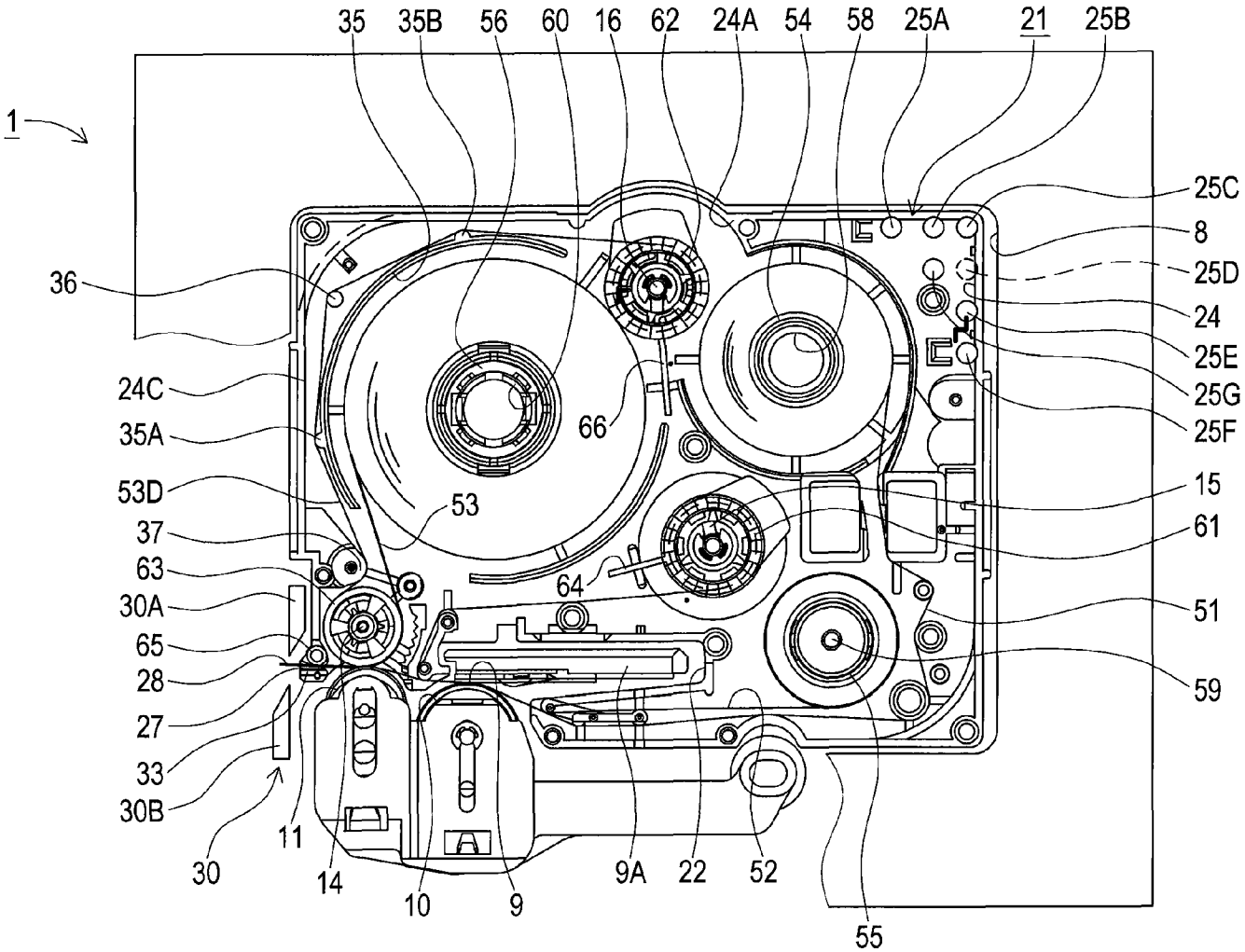
FIG. 4 is a main-part-enlarged plain view that can be seen in case an upper case of the stripped-tape accommodating cassette is removed while the stripped-tape accommodating cassette is placed in the cassette housing portion of the tape printing apparatus.

As shown in FIG. 3 and FIG. 4, the stripped-tape accommodating cassette 21 includes an upper case 23 and a lower case 24. In the stripped-tape accommodating cassette 21, a supporting hole 41 is formed so as to rotatably support a tape spool 54 on which a transparent film tape 51 as printing tape is wound. Further, in the stripped-tape accommodating cassette 21, a supporting hole 42 is formed so as to rotatably support a two-sided-adhesive-tape spool 56. A two-sided adhesive tape 53 is wound around the two-sided-adhesive tape spool 56 while its separator 53D (refer to FIG. 7) made of release paper, film or the like is put outward.

Further, in the stripped-tape accommodating cassette 21, a supporting hole 43 is formed so as to rotatably support a ribbon-take-up spool 61 that is arranged between the tape spool 54 and the two-sided-adhesive-tape spool 56 near the opening 22. For printing characters etc. on a film tape 51 with the thermal head 9, the ribbon-take-up spool 61 serves to pull out the ink ribbon 52 from the ribbon spool 55 and to take up the ink ribbon 52 therein.

Further, in the stripped-tape accommodating cassette 21, a supporting hole 44 is formed so as to rotatably support a separator-take-up spool 62 that is arranged near a side wall 24A furnished on the lower case 24 that faces the opening 22 located between the tape spool 54 and the two-sided-adhesive-tape spool 56. The separator-take-up spool 62 takes up therein a separator 53D that has been peeled off from a two-sided adhesive tape 53 along the peripheral surface of the tape conveying roller 63. Further, the side wall 24A on the lower case 24 is formed so as to project like a semicircular arc when seen from top at a portion facing the separator-take-up spool 62.

Further, in the stripped-tape accommodating cassette 21, a supporting hole 48 is formed so as to rotatably support the contract roller 65 that is arranged at the downstream of the tape conveying direction with reference to the tape conveying roller 63, i.e., the contact roller 65 is arranged so as to be away from the tape ejecting port 27.

Figure 5:
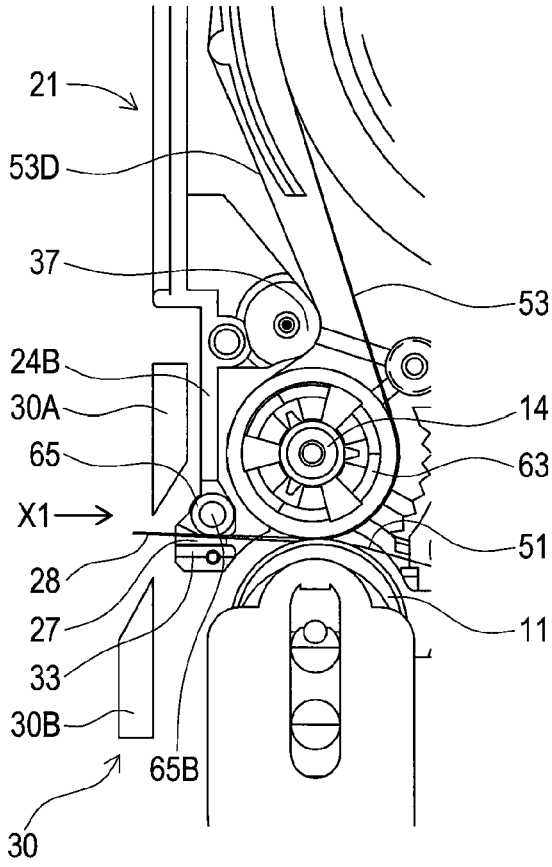
FIG. 5 is a main-part-enlarged view of surroundings of a tape ejecting port shown in FIG. 4.
Figure 6:
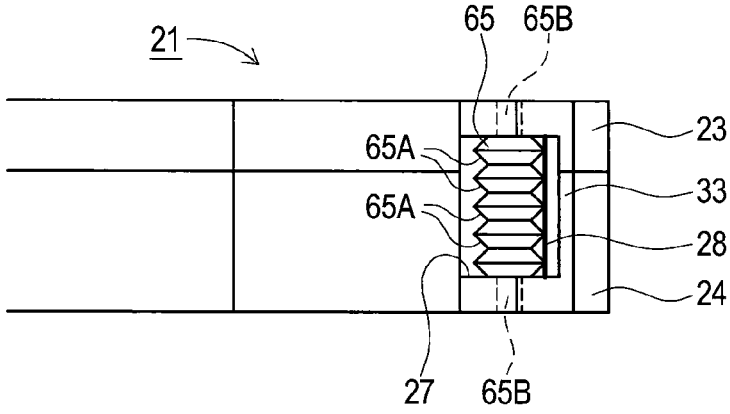
FIG. 6 is a view of the tape ejecting port seen from a view point indicated with an arrow X1 shown in FIG. 5.

As shown in FIG. 5 and FIG. 6, the peripheral surface of the contact roller 65 is formed of grooves 65A that are continuous in the axial direction thereof. Each of the grooves 65A is a V-shaped groove in cross section along the axial direction and both ends of the contact roller 65 are chamfered slantwise toward the axis thereof. That is, the peripheral surface of the contact roller 65 consists of plural convexes formed in parallel with the axial direction wherein each of the convexes is substantially triangular shaped in cross section along the axial direction.

Further, supporting shafts 65B are arranged upright on centers of both side ends of the contact roller 65 and rotatably fitted in their respective supporting holes 48. Further, the contact roller 65 is formed so as to have a silicon resin film on its peripheral surface. The contact roller 65 guides an after-printed tape 28 from the tape ejecting port 27 to the downstream of the tape conveying direction while getting in contact with an adhesive layer 53C (refer to FIG. 7) of the after-printed tape 28 from which the separator 53D has been peeled off.

Further, the contact roller 65 comes out in the tape conveying direction in comparison with the side wall 24B that faces the tape conveying roller 63. At the same time, the contact roller 65 is arranged so as to closely face the fixed blade 30A.

Further, the guide wall 33 faces the contact roller 65 over an after-printed tape 28 inserted therebetween. At the same time, the guide wall 33 is arranged so as to extend to the downstream of the tape conveying direction in comparison with the contact roller 65. Thereby, travel of an after-printed tape 28 from which a separator 53D has been peeled off can be guided to a position near the fixed blade 30A.

Further, the stripped-tape accommodating cassette 21 includes a guide rib 35 within a space between an outer circumference of a two-sided adhesive tape 53 wound around the two-sided-adhesive-tape spool 56 with its greatest dimension and the side walls 24A and 24C of the lower case 24. The guide rib 35 is substantially semicircular shaped when seen from top and is arranged upright on the bottom of the lower case 24 so as to partially cover the two-sided adhesive tape 53. That is, the guide rib 35 extends from where the two-sided adhesive tape 53 is to be pulled out to where the two-sided adhesive tape 53 faces the side wall 24A. Further, a convex part 35A and a convex part 35B are formed on the guide rib 35 so as to project from the side facing the side wall 24C and the side wall 24A of the lower case 24, by predetermined height (e.g., about 1 mm) across tape width direction.

Further, a substantially column-shaped guide pin 36 is arranged upright in a space between a corner of the lower case 24 facing two-sided adhesive tape 53 wound around the two-sided-adhesive-tape spool 56 and the guide rib 35. Further, at a position to facet the guide pin 36 of the upper case 23, a supporting hole 49 is formed so that an end portion of the guide pin 36 is fitted therein and the guide pin 36 is supported. Further, at another side of the tape conveying roller 63 which is the opposite side where the tape conveying roller 63 faces the tape sub roller 11, a separator guide wall 37 is arranged. The separator guide wall 37 is formed so as to get in contact with a separator 53D and its contact surface is substantially circular shaped when seen from top. The separator guide wall 37 projects inwardly while a predetermined space that extends from the side wall 24C to the tape conveying roller 63 is taken around the separator guide wall 37.

Although FIG. 3 shows only supporting holes 41, 42, 43, 44 and 48 formed on the upper case 23, supporting holes 41, 42, 43, 44 and 48 are also formed on the lower case 24 so as to meet with the corresponding supporting holes 41, 42, 43, 44 and 48 on the upper case 23.

Further, as shown in FIG. 4, inside the stripped-tape accommodating cassette 21, there are accommodated a film tape 51 that is a printing tape made of a transparent tape or the like, an ink ribbon 52 for printing on the film tape 51 and a two-sided adhesive tape 53 that is to be adhered onto a printing-applied film tape 51. The film tape 51, the ink ribbon 52 and the two-sided adhesive tape 53 are wound around a tape spool 54, a ribbon spool 55 and a two-sided-adhesive-tape spool 56, respectively. At the bottom of the lower case 24, a cassette boss 58, a reel boss 59 and a cassette boss 60 are arranged upright and rotatably fitted with the tape spool 54, the ribbon spool 55 and the two-sided-adhesive-tape spool 56, respectively. Still further, inside the stripped-tape accommodating cassette 21, there are also arranged a ribbon-take-up spool 61 for taking up a used ink ribbon 52 and a separator-take-up spool 62 for taking up a separator 53D peeled off from a two-sided adhesive tape 53.

As shown in FIG. 4, a clutch spring 64 is arranged at a lower part of the ribbon-take-up spool 61. The clutch spring 64 is arranged there so as to prevent slack of an ink ribbon 52 that has been taken up into the ribbon-take-up spool 61 by rotating it inversely. Further, a clutch spring 66 is arranged at a lower part of the separator-take-up spool 62. The clutch spring 66 is arranged there so as to prevent slack of a separator 53D that has been taken up into the separator-take-up spool 62 by rotating it inversely.

As shown in FIG. 4, after pulled out from the ribbon spool 55, an unused ink ribbon 52 is overlaid with a film tape 51. Thereafter, the unused ink ribbon 52 overlaid with the film tape 51 goes into the opening 22 and passes through a path between the thermal head 9 and the platen roller 10. After that, the ink ribbon 52 is separated from the film tape 51 and guided to reach the ribbon-take-up spool 61 driven by the ribbon-take-up shaft 15 for rotation. The ink ribbon 52 guided there is taken up into the ribbon-take-up spool 61.

Figure 7:
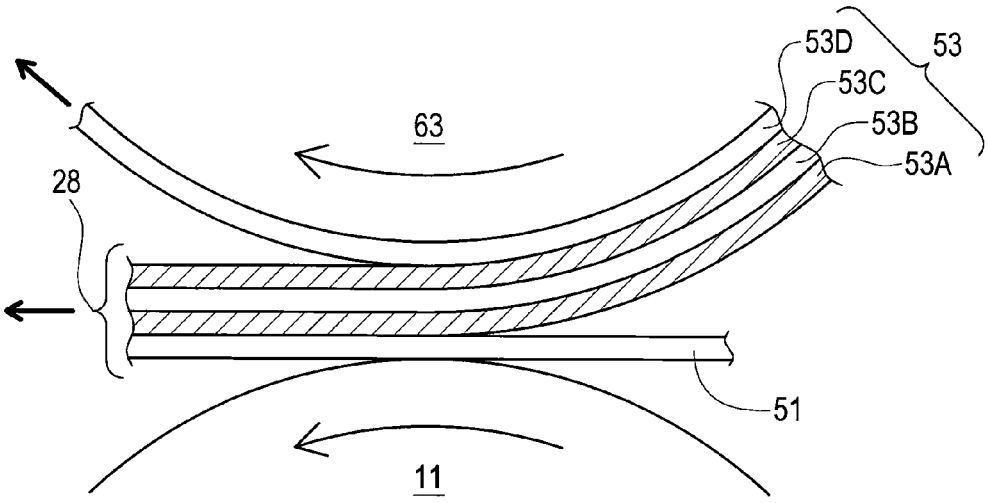
FIG. 7 is a view for exemplarily illustrating a state that a separator is peeled off after a two-sided adhesive tape is adhered to a film tape with pressure.

Further, as shown in FIG. 7, a two-sided adhesive tape 53 is wound around the two-sided-adhesive-tape spool 56 in a state that a separator 53D is put outermost. The two-sided adhesive tape 53 consists of four layers, namely in order from the lower to top in FIG. 7: an adhesive layer 53A for bonding a film tape 51 together; a base film 53B made of colored PET (polyethylene terephthalate) or the like; an adhesive layer 53C subject to be pasted on a commercial product etc.; and a separator 53D for covering the to-be-pasted side of the adhesive layer 53C.

As shown in FIG. 4 through FIG. 7, a two-sided adhesive tape 53 that has been pulled out from the two-sided-adhesive spool 56 travels and passes through a path between the tape conveying roller 63 driven by the tape-driving-roller shaft 14 for rotation and the tape sub roller 11. Thereafter, the adhesive layer 53A on which the separator 53D is not overlaid is pressed against the printing surface of the film tape 51.

After that, the separator 53D is peeled off from the two-sided adhesive tape 53 so as to be pressed and adhered to the film tape 51. With that state, the separator 53D is further guided toward the two-sided adhesive spool 56 along the peripheral surface of the tape conveying roller 63, i.e., toward the pull-out direction of the two-sided adhesive tape 53 (upward direction in FIG. 4). After that, the separator 53D is further guided to reach the external of the guide rib 35 along a wall surface of the separator guide wall 37. From there, the separator 53D further travels the outside of the periphery of the wound two-sided adhesive tape 53 passing through peripheral surfaces of the convex part 35A, the guide pin 36 and the convex part 35B. The separator 53D finally reaches the separator-take-up spool 62 inwardly at a substantially right angle.

Thereafter, the front end of the separator 53D is fixedly adhered to the peripheral surface of the separator-take-up spool 62 by an adhesive tape or the like and taken up into the separator-take-up spool 62 that is driven by the separator-take-up shaft 16 for rotation. It is to be noted that the separator-take-up shaft 16 is driven for rotation in synchronous with rotation of the tape-driving-roller shaft 14 and the ribbon-take-up shaft 15.

After passing through the path between the tape conveying roller 63 driven by the tape-driving-roller shaft 14 for rotation and the tape sub roller 11, a film tape 51 reaches the contact roller 65 in a state that an adhesive layer 53A, a base film 53B and an adhesive layer 53C are overlaid on a printing surface of the film tape 51. Thereafter, the film tape 51 is consequently placed in a state that the adhesive layer 53A, the base film 53B and the adhesive layer 53C are overlaid on the printing surface thereof, i.e., in a state of a sticky after-printed tape 28 is guided along the guide wall 33 that faces the contact roller 65 over an after-printed tape 28 inserted therebetween and conveyed to the outside of the stripped-tape accommodating cassette 21 through the tape ejecting port 27. After that, through the cutter unit 30, the sticky after-printed tape 28 from which the separator 53D has been peeled off is conveyed outside from the label ejecting port 17 of the tape printing apparatus 1.

The after-printed tape 28 is conveyed by predetermined length and the cutting motor 105 is driven for operating the movable blade 30B. Consequently, from the label ejecting port 17, there is ejected the predetermined length of the sticky after-printed tape 28 from which the separator 53D has been peeled off.

By the way, as shown in FIG. 4, of the lower case 24, at a corner to face the tape spool 54 where the film tape 51 is wound, there are seven cassette identifying holes 25A through 25G in an L-like arrangement manner. Those cassette identifying holes are adopted so as to identify a type of a tape cassette (e.g. a stripped-tape accommodating cassette 21 for creating a sticky after-printed tape 28 from which a separator 53D is peeled off, a normal-tape accommodating cassette 81 for creating an after-printed tape with separator 53D adhered on its adhesive layer, etc.), a tape width (e.g., five different tape width of 6 mm, 9 mm, 12 mm, 18 mm and 24 mm), tape material, etc.

It is to be noted that a specific portion of each of the seven cassette identifying holes 25A through 25G is configured so as to penetrate depending on tape cassette type, tape width, etc. For instance, with respect to the stripped-tape accommodating cassette 21 shown in FIG. 4, out of the seven cassette identifying holes 25A through 25G, six of the cassette identifying holes 25A, 25B, 25C, 25E, 25F and 25G are formed so as to penetrate, while a cassette identifying hole 25 D is formed so as not to penetrate.

Further, of the cassette housing portion 8, on the bottom portion facing each of the seven cassette identifying holes 25A through 25G, there are arranged seven cassette sensors P1 through P7 (refer to FIG. 11) in an L-like arrangement manner. Each of those cassette sensors P1 through P7 is formed of a push-type micro switch or the like and serves to detect presence and absence of each of the cassette identifying holes 25A through 25G.

Each of those cassette sensors P1 through P7 is formed of a heretofore-known mechanical switch consisting of a plunger, a micro switch, etc., wherein an upper end of each plunger is arranged so as to penetrate each of those cassette identifying holes 25A through 25G and poke out. Presence or absence is detected between each of the cassette sensors P1 through P7 and each of the cassette identifying holes 25A through 25G, whereby a tape cassette type, tape width and tape material etc of a tape housed in the cassette housing portion 8 can be identified with an ON signal and an OFF signal both of which reflect detection result.

In the case of the present embodiment, with respect to each of the cassette sensors P1 through P7, a plunger is arranged so as to always poke out from their respective cassette identifying holes 25A through 25G and a micro switch is set in an off state. In case the cassette identifying holes 25A through 25G each are arranged at their respective positions to face the cassette sensors P1 through P7, their respective plungers are not depressed and their respective micro switches are set in an off state. Consequently, an off signal is outputted.

On the other hand, in case the cassette identifying holes 25A through 25G each are not arranged at their respective positions to face the cassette sensors P1 through P7, their respective plungers are depressed and their respective micro switches are set in an on state. Consequently, an on signal is outputted. Accordingly, each of the cassette sensors P1 through P7 makes up each bit of a seven-bit signal consisting of a combination of "0" and "1". In case all the cassette sensors P1 through P7 are in an off state, i.e., in case a tape cassette is not housed, a seven-bit signal of "0000000" is outputted.

Out of seven of the cassette identifying holes 25A through 25G, six of those holes are formed at maximum. Therefore, by associating presence and absence with "1" and "0", respectively, with respect to each of the cassette identifying holes 25A through 25G, tape cassette type, tape width, tape material, etc. can be detected with a seven-bit correspondence that ranges from "0000001" to "1111111". For instance, in case the stripped-tape accommodating cassette 21 is housed in the cassette housing portion 8, this fact can be detected with a seven-bit correspondence of "0001000".

Next, by referring to FIG. 8 through FIG. 10, there will be described on schematic configuration of a normal-tape accommodating cassette 81 that creates an after-printed tape 85 with a separator 53D being adhered on its adhesive layer.

In the following description of the normal-tape accommodating cassette 81 illustrated with FIG. 8 through FIG. 10, there are numerals and signs identical with those assigned to constituent elements of the stripped-tape accommodating cassette 21 illustrated with FIG. 3 through FIG. 7. Those identical numerals and signs are assigned to constituent elements of the normal-tape accommodating cassette 81 are completely or substantially identical with those constituting the stripped-tape accommodating cassette 21.

Figure 8:
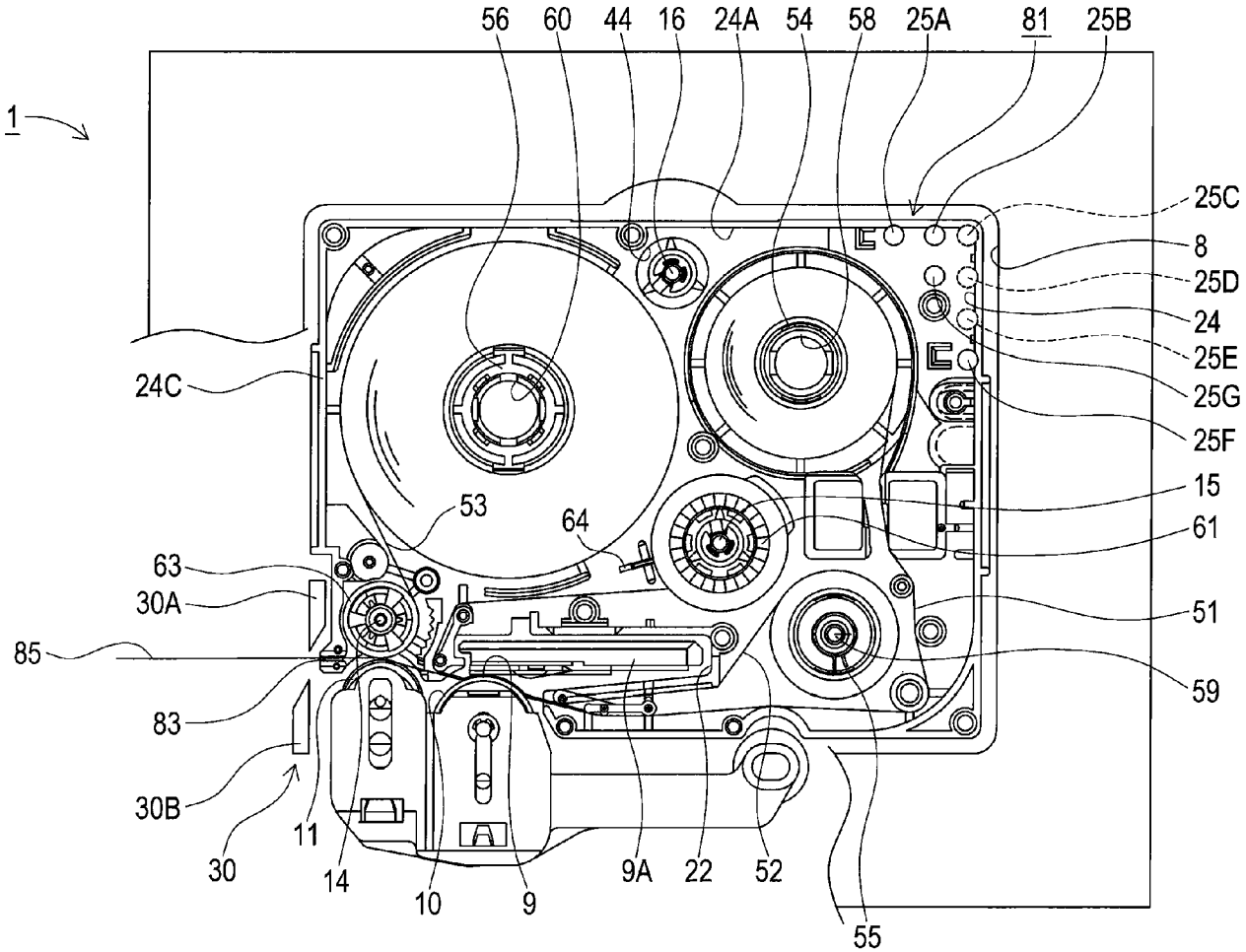
FIG. 8 is a main-part-enlarged plain view that can be seen in case an upper case of a normal-tape accommodating cassette is removed while the normal-tape accommodating cassette is placed in the cassette housing portion of the tape printing apparatus.
Figure 9:
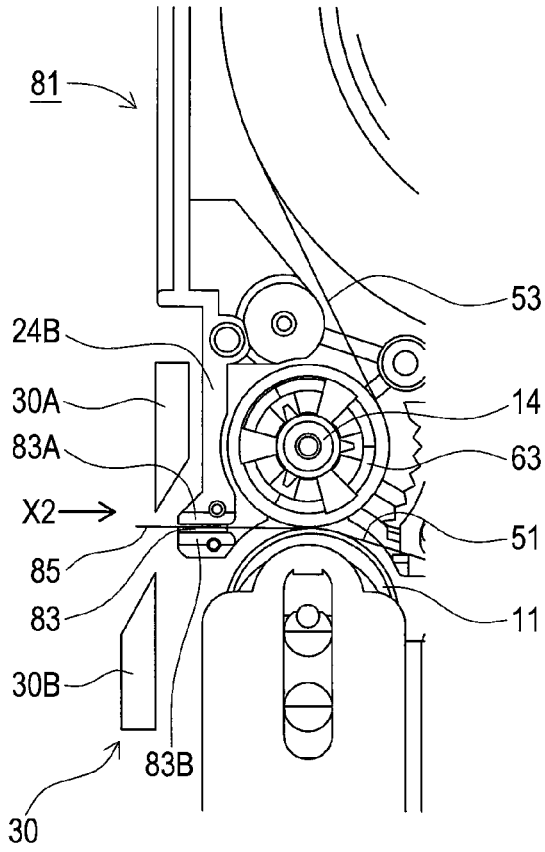
FIG. 9 is a main-part-enlarged view of surroundings of a tape ejecting port shown in FIG. 8.
Figure 10:
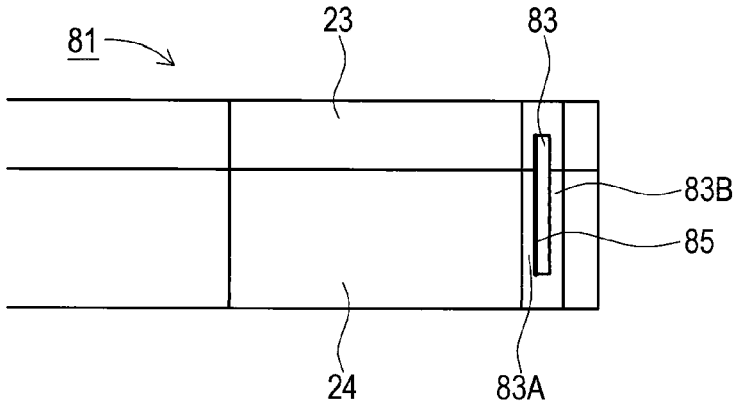
FIG. 10 is a view of the tape ejecting port seen from a view point indicated with an arrow X2 shown in FIG. 9.

As shown. in FIG. 8 through FIG. 10, the schematic configuration of the normal-tape accommodating cassette 81 is almost the same as that of the stripped-tape accommodating cassette 21.

However, as shown in FIG. 8 through FIG. 10, the normal-tape accommodating cassette 81 does not include a separator-take-up spool 62. Therefore, a separator-take-up shaft 16 is arranged so as to penetrate a supporting hole 44. Further, a side wall 24A facing the supporting hole 44 does not protrude outwardly. Still further, a contact roller 65 is not arranged, and instead of a tape ejecting port 27, a tape ejecting port 83 is formed.

Further, the tape ejecting port 83 for ejecting an after-printed tape 85 with a separator 53D being adhered on its adhesive layer is formed so as to have a slit-like shape when seen from front, with predetermined width (e.g., about 3 mm of width) in the tape conveying direction. The tape ejecting port 83 is constituted by a guide wall 83A and a guide wall 83B that faces the guide wall 83A over the after-printed tape 85. The guide wall 83A is configured to face the separator 53D of the after-printed tape 85. The guide wall 83B is configured to guide the after-printed tape 85 to the downstream of the tape conveying direction while getting in contact with an outer surface of the film tape 51 of the after-printed tape 85. The guide wall 83A and the guide wall 83B are arranged so as to be away from each other by predetermined distance (e.g., about 1 mm). Further, the guide wall 83A and the guide wall 83B are arranged so as to face each other on a common tangent of a tape conveying roller 63 and a tape sub roller 11.

Further, the downstream-side edge portion of the guide wall 83A and that of the guide wall 83B are configured to come out in the downstream of the tape conveying direction in comparison with the side wall 24B that faces the tape conveying roller 63, whereby the guide walls 83A and 83B closely face the fixed blade 30A. Thus, the guide walls 83A and 83B are arranged so as to be able to guide the after-printed tape 85 near the fixed blade 30A As shown in FIG. 8 through FIG. 10, the two-sided adhesive tape 53 that has been pulled out from the two-sided-adhesive spool 56 travels and passes through a path between the tape conveying roller 63 driven by the tape-driving-roller shaft 14 for rotation and the tape sub roller 11. Thereafter, the adhesive layer 53A on which the separator 53D is not overlaid is pressed against the printing surface of the film tape 51.

After the two-sided adhesive tape 53 is adhered to the film tape 51 on its printing surface, the after-printed tape 85 with the separator 53D adhered on its adhesive layer is conveyed to the outside of the normal-tape accommodating cassette 81 through the tape ejecting port 83. Thereafter, through the cutter unit 30, the after-printed tape 85 with the separator 53D adhered on its adhesive layer is ejected outside from the label ejecting port 17 of the tape printing apparatus 1.

The after-printed tape 85 is conveyed by predetermined length and the cutting motor 105 is driven for operating the movable blade 30B. Consequently, from the label ejecting port 17, there is ejected the predetermined length of the after-printed tape 85 with the separator 53D being adhered on its adhesive layer.

As shown in FIG. 8, of the lower case 24 for the normal-tape accommodating cassette 81, at a corner to face the tape spool 54 where the film tape 51 is wound, there are seven cassette identifying holes 25A through 25G. The cassette identifying holes 25A, 25B, 25F and 25G are formed so as to penetrate while the cassette identifying holes 25C and 25E are formed so as not to penetrate. In case the normal-tape accommodating cassette 81 is housed in the cassette housing portion 8, this fact can be detected with a seven-bit correspondence of "0011100".

Next, the circuit configuration of the tape printing apparatus 1 will be described by referring to FIG. 11.

As shown in FIG. 11, a control circuit unit 90 is installed on a control board 12 of the tape printing apparatus 1. The control circuit unit 90 includes a CPU 91, a CG (character generator) ROM 92, a ROM 93, a flash memory 94, a RAM 95, an input/output interface (I/F) 96, a communication interface (I/F) 97 and the like. Further, the CPU 91, the CGROM 92, the ROM 93, the flash memory 94, the RAM 95, the input/output interface (I/F) 96 and the communication interface (I/F) 97 are mutually connected by bus lines 98 for mutual data exchange.

Dot data patterns associated with respective characters are stored in the CGROM 92. When dot pattern data are read out from the CGROM 92, dot patterns are displayed in the liquid crystal display (LCD) 7 based on the read-out dot pattern data.

Further, the ROM 93 stores various programs. Specifically, as will be described later, there are stored various programs necessary for controlling the tape printing apparatus 1, such as print control process program (refer to FIG. 12) for controlling the number of to-be printed printing tapes depending on type of a tape cassette.

The CPU 91 executes various operations based on the various programs stored in the ROM 93. The ROM 93 also stores outline data for defining outlines of various characters and letters wherein the outline data are classified by fonts (Gothic, Mincho, etc.) and associated with each of the code data. Based on the outline data, dot pattern data are expanded on a printing buffer 95B.

The flash memory 94 assigns registration numbers to dot pattern data of plural sizes of external characters coming from an external computer and those of various figure data and stores them with registration numbers. Even though the power of the tape printing apparatus 1 is turned off, the flash memory 94 holds memory contents.

Further, the RAM 95 temporarily stores various operation results obtained by the operation of the CPU 91. When printing is to be carried out on a film tape 51 with the thermal head 9, the RAM 95 also temporarily stores printing data. Further, the RAM 95 includes various memories, namely, a text memory 95A, a printing buffer 95B, etc.

The text memory 95A stores editorial texts of document data inputted with the keyboard 6 and those of printing data of external character data. The printing buffer 95B stores dot patters of plural characters, signs, etc. and the number of pulses to be applied as energy amount when forming each dot, as dot pattern data. The thermal head 9 carries out dot printing in accordance with printing dot pattern data stored in the printing buffer 95B.

Further, the input/output I/F 96 is connected with the keyboard 6, each of the cassette sensors P1 through P7, the display controller (LCDC) 101 that includes a video RAM for outputting display data to the liquid crystal display (LCD) 7, the driving circuit 102 for driving the thermal head 9, the driving circuit 104 for driving the tape conveying motor 103, and the driving circuit 106 for driving the cutting motor 105.

Further, the communication I/F 97 is constituted by a USB (Universal Serial Bus) connector 19 or the like, for instance, and connected to an external computer with a USB cable so as to communicate mutually.

Therefore, in case letters etc. are inputted with the letter input keys 2 of the keyboard 6, the corresponding texts (document data) are sequentially stored in the text memory 95A. At the same time, dot patterns corresponding to letters etc. inputted with the keyboard 6 based on a dot pattern creation control program, a display drive control program, etc. are indicated in the liquid crystal display (LCD) 7.

Further, the thermal head 9 is driven by the driving circuit 102 so as to carry out printing of the to-be printed dot pattern data stored in the printing buffer 95B. In synchronous with this, driving of the tape conveying motor 103 is controlled by the driving circuit 104 so as to convey the ink ribbon 52, the film tape 51 and the two-sided adhesive tape 53. Further, the text memory 95A sequentially stores printing data inputted from the external computer through the communication I/F 97. Thereafter, based on the dot pattern creation control program, the printing data is processed and stored in the printing buffer 95B as printing dot pattern data. Subsequently, the thus inputted printing data is printed out on the film tape 51 with the thermal head 9.

Next, by referring to FIG. 12, there will be described on a print control process for controlling the to-be-printed number of printing tapes depending on type of a tape cassette placed in the cassette housing portion 8, wherein the control process is executed by the CPU 91 of the tape printing apparatus 1.

Figure 12:
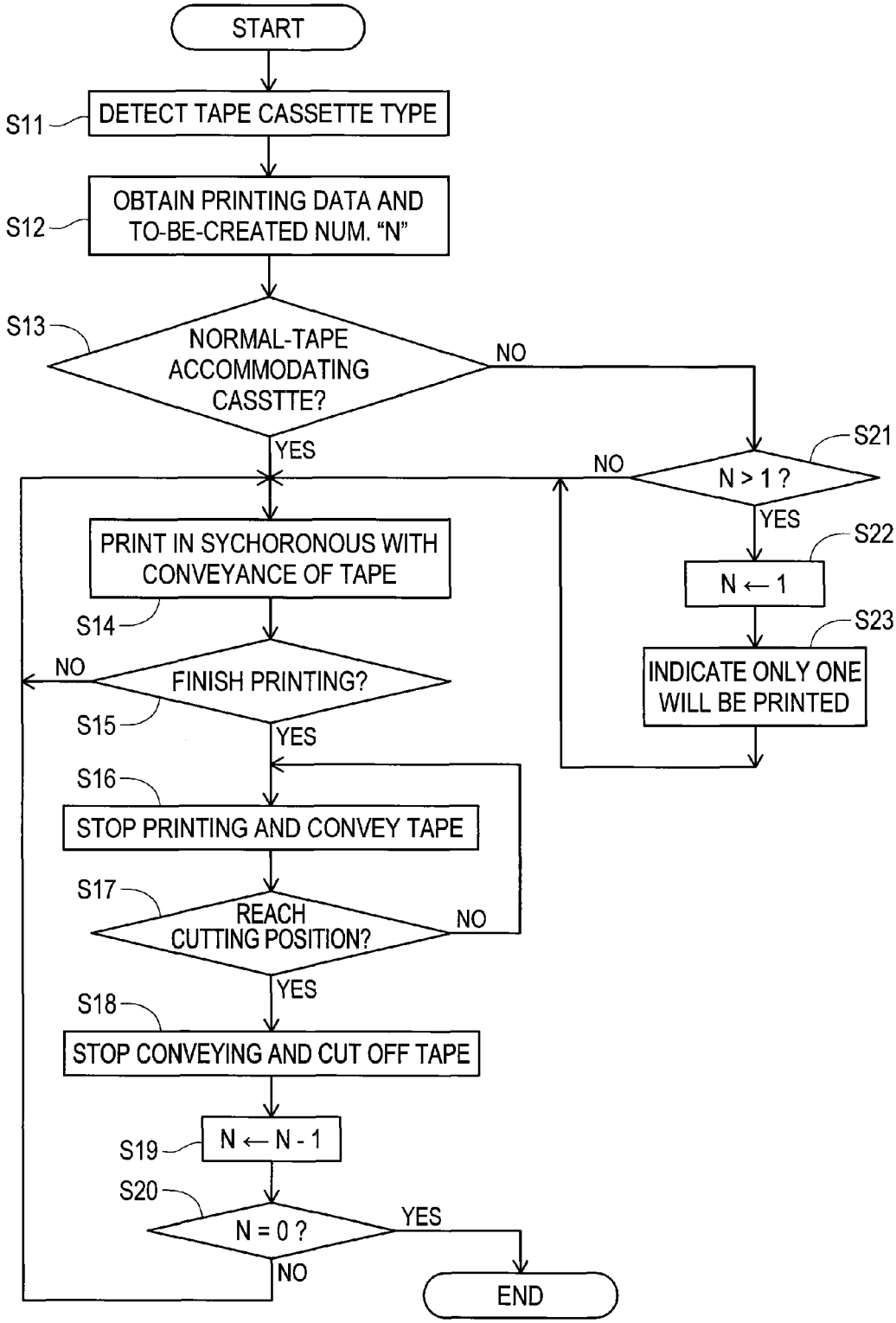
FIG. 12 is a flowchart of a print control process for controlling the number of to-be printed printing tapes depending on type of a tape cassette placed in the cassette housing portion, wherein the control process is executed by a CPU of the tape printing apparatus.

As shown in FIG. 12, at step (abbreviated as S, hereinafter) 11, the CPU 91 detects a tape cassette type housed in the cassette housing portion 8 through each of the cassette sensors P1 through P7. Thereafter, in case it is detected that the stripped-tape accommodating cassette 21 or the like for creating an after-printed tape 28 with a separator 53D being peeled off from its adhesive layer has been housed, the CPU 91 reads a cassette flag from the RAM 95, sets the cassette flag in an ON state and again stores the ON-state cassette flag in the RAM 95.

On the other hand, it is detected that the normal-tape accommodating cassette 81 or the like for creating an after printed tape with a separator 53D being adhered on its adhesive layer has been housed, the CPU 91 reads a cassette flag from the RAM 95, sets the cassette flag in an OFF state and again stores the OFF-state cassette flag in the RAM 95. It is to be noted that the cassette flag is set in an OFF state and stored as so in the RAM 95 when the tape printing apparatus 1 is initialized.

For instance, as already described, in case a seven-bit signal of "0001000" made up of correspondences from the respective cassette sensors P1 through P7 is inputted, the CPU 91 detects that the stripped-tape accommodating cassette 21 or the like for creating an after-printed tape 28 with a separator 53D being peeled off from its adhesive layer has been housed. Thereafter, the CPU 91 reads out the cassette flag from the RAM 95, sets the cassette flag in an ON state and again stores the ON-state cassette flag in the RAM 95 again.

As already described, in case a seven-bit signal of "0011100" made up of correspondences from the respective cassette sensors P1 through P7 is inputted, the CPU 91 detects that the normal-tape accommodating cassette 81 or the like for creating an after printed tape 85 with a separator 53D being adhered on its adhesive layer has been housed. Thereafter, the CPU 91 reads a cassette flag from the RAM 95, sets the cassette flag in an OFF state and again stores the OFF-state cassette flag in the RAM 95 again.

At S12, the CPU 91 sequentially stores printing data inputted with the letter input keys 2 or the like in the text memory 95A and stores "N", the number of copies, inputted with the letter input keys 2 or the like in the RAM 95.

Next, at S13, the CPU 91 detects whether or not a tape cassette housed in the cassette housing portion 8 is the normal-tape accommodating cassette 81 or the like for creating an after printed tape 85 with a separator 53D being adhered on its adhesive layer. That is, the CPU 91 executes a process to detect whether or not the cassette flag is set in an OFF state by reading out the cassette flag from the RAM 95.

In case it is detected that the tape cassette housed in the cassette housing portion 8 is the normal-tape accommodating cassette 81 or the like for creating an after printed tape 85 with a separator 53D being adhered on its adhesive layer, i.e., it is detected that the cassette flag readout from the RAM 95 is set in an OFF state (S13: YES), the CPU 91 shifts the process to S14.

At S14, the CPU 91 reads out printing data from the text memory 95A, creates printing dot pattern data from the printing data with the aid of the dot pattern data creation control program and stores the thus created printing dot pattern data in the printing buffer 95B. Thereafter, the CPU 91 drives the thermal head 9 with the aid of the driving circuit 102 so as to carry out printing of the printing dot pattern data stored in the printing buffer 95B and in synchronous with this operation, drives the tape conveying motor 103 with the aid of the driving circuit 104 so as to carry out conveyance control of the ink ribbon 52, the film tape 51 and the two-sided adhesive tape 53.

Next, at S15, the CPU 91 detects whether or not the entirety of the printing dot pattern data stored in the printing buffer 95B is printed out with the thermal head 9. That is, the CPU 91 executes a process to detect whether or not printing is finished. In case printing is not finished (S15: NO), the CPU 91 repeats processes to follow S14.

On the other hand, in case printing is finished (S15: YES), the CPU 91 shifts the process to S16. At S16, the CPU 91 stops operation of the thermal head 9 with the aid of the driving circuit 102 and in synchronous with this, drives the tape conveying motor 103 with the aid of the driving circuit 104 so as to convey the after-printed tape 85 with the separator 53D being adhered on its adhesive layer to a cutting position of the cutter unit 30.

Next, at S17, the CPU 91 detects whether or not the after-printed tape 85 with the separator 53D being adhered on its adhesive layer is conveyed to the cutting position of the cutter unit 30. In case it is detected that the after-printed tape 85 with the separator 53D being adhered on its adhesive layer is not conveyed to reach the cutting position of the cutter unit 30 (S17: NO), the CPU 91 repeats processes to follow S16.

On the other hand, in case it is detected that the after-printed tape 85 with the separator 53D being adhered on its adhesive layer is conveyed to reach the cutting position of the cutter unit 30 (S17: YES), the CPU 91 shifts the process to S18. At S18, the CPU 91 stops the operation of the tape conveying motor 103 with the aid of the driving circuit 104 and in synchronous with this, drives the movable blade 30B with the aid of the cutting motor 105 so as to cut off by predetermined length the after-printed tape 85 with the separator 53D being adhered on its adhesive layer. After that the thus cut-off after-printed tape 85 is ejected from the label ejecting port 17.

Next, at S19, the CPU 91 reads out "N", the to-be-created number, from the RAM 95 and subtracts "1" from "N" and again stores new "N" as the new to-be-created number in the RAM 95.

Next, at S20, the CPU 91 reads out "N", the number of copies, from the RAM 95 and carries out a process to detect whether or not "N" is "0". In case "N", the to-be created number, is not "0" (S20: NO), the CPU 91 repeats processes to follow S14.

On the other hand, in case "N", the to-be-created number, is "0" (S20: YES), the CPU 91 terminates the series of processes.

Alternatively, at S13, in case it is detected that the tape cassette housed in the cassette housing portion 8 is the stripped-tape accommodating cassette 21 or the like for creating an after-printed tape 28 with a separator 53D being peeled off from its adhesive layer, i.e., it is detected that the cassette flag read out from the RAM 95 is set in an ON state (S13: NO), the CPU 91 shifts the process to S21.

At S21, the CPU 91 reads out "N", the to-be-created number of copies, from the RAM 95 so as to detect whether or not "N" is larger than "1", i.e., whether or not the number of copies is two or larger.

In case "N", the to-be-created number, is larger than "1", i.e., in case the to-be-created number is two or larger (S21: YES), the CPU 91 shifts the process to S22. At S22, the CPU 91 again reads out "N", the to-be-created number of copies, from the RAM 95, substitutes "1" for "N" as the new to-be-created number and stores the new "N" in the RAM 95.

Next, at S23, the CPU 91 indicates in the liquid crystal display 7 a message that only one will be printed and subsequently repeats processes to follow S14. For instance, the CPU 91 indicates in the liquid crystal display 7 a message that "only one will be printed" and subsequently shifts the process to S14.

In case "N", the to-be-created number, is "1", i.e., in case the to-be-created number is one (S21: NO), the CPU 91 shifts the process to S14.

Next, the CPU 91 carries out the processes of S14 through S20, whereby the after-printed tape 28 with the separator 53D being peeled off from its adhesive layer is cut off by predetermined length, subsequently ejected from the label ejecting port 17 and tape printing operation is terminated.

Accordingly, in the tape printing apparatus 1 of the present embodiment, in case the CPU 91 detects that a type of a tape cassette housed in the cassette housing portion 8 is the stripped-tape accommodating cassette 21 for creating an after-printed tape 28 with a separator 53D being peeled off from its adhesive layer, only one after-printed tape 28 in predetermined length with a separator 53D being peeled off from its adhesive layer is ejected from the label ejecting port 17 and tape printing operation is terminated.

Thereby, in case the stripped-tape accommodating cassette 21 is housed in the tape housing portion 8, even if it is set to print plural copies with the keyboard 6, the only one is created, conveyed to the cutting point, cut off by predetermined length, and printing on the film tape 51 is terminated. Therefore, even though an after-printed tape 28 with a separator 53D being peeled off from its adhesive tape is ejected from the stripped-tape accommodating cassette 21, it can be prevented that plural after-printed tapes 28 with a separator 53D being peeled off from their respective adhesive tapes and being cut off by predetermined length get adhered overlapping with one another near the label ejecting port 17 of the tape printing apparatus 1.

Further, in case the stripped-tape accommodating cassette 21 is housed in the tape housing portion 8, the two-sided adhesive tape 53 gets pressed and adhered on the printing surface of the film tape 51 by the tape conveying roller 63 and the tape sub roller 11 and further conveyed in a state that the separator 53D is peeled off from its adhesive layer. Thereby, time and effort to peel off the separator 53D is made eliminable when the after-printed tape 28 cut in predetermined length is to be pasted on a commercial product etc.

In case the stripped-tape accommodating cassette 21 is housed in the tape housing portion 8, only one after-printed tape 28 with a separator 53D being peeled off from its adhesive layer is created and automatically cut off by the cutter unit 30. Therefore, a predetermined length of after-printed tape 28 with a separator 53D being peeled off from its adhesive layer can be created at ease.

In case the stripped-tape accommodating cassette 21 is housed in the tape housing portion 8 and the number of copies is set to two or larger, a massage that only one will be printed is indicated in the liquid crystal display 7. Thereby, a user can easily recognize that the same printing data must be set again for printing.

Further, in case the normal-tape accommodating cassette 81 for creating an after-printed tape 85 with a separator 53D being adhered on its adhesive layer is housed in the tape housing portion 8, successive printing is carried out as may as the to-be-created number set by a user. Thereby, plural number of predetermined length of after-printed tape 85 with separators 53D being adhered on their respective adhesive layers can be created successively.

It is to be noted that the disclosure is not restricted to aspects directed to the present embodiment and that various changes and modification may be made without departing from the gist of the disclosure. There may be modified as below, for instance.

(A) On the label ejecting port 17, there may be arranged a detection unit consisting of a reflective light sensor or the like so as to detect an after-printed tape 28. In case the stripped-tape accommodating cassette 21 is housed in the cassette housing portion 8 and two or more copies are to be printed, the CPU 91 may be configured to create a next after-printed tape 28 until reaching the to-be-created number every time the detection unit detects that an after-printed tape 28 ejected from the label ejecting port 17 is completely taken out.

(B) On the label ejecting port 17, there may be arranged a detection unit consisting of a pryoelectric infrared sensor or the like so as to detect a user's finger. Specifically, in case the stripped-tape accommodating cassette 21 is housed in the cassette housing portion 8 and two or more copies are to be printed, the CPU 91 may be configured to create a next after-printed tape 28 until reaching the to-be-created number. Thereby, in case a user's finger is detected at the label ejecting port 17 after an after-printed tape 28 is ejected to the label ejecting port 17, it may be regarded as a detection of complete removal of the thus ejected after-printed tape 28.

(C) In case the stripped-tape accommodating cassette 21 is housed in the cassette housing portion 8, the CPU 91 may be configured to store last inputted printing data in the printing buffer 95B. Thereby, in case the printing key 3 is depressed after an after-printed tape 28 is ejected to the label ejecting port 17, the last inputted printing data is printed on a film tape 51 so as create only one after-printed tape 28 again.

What is claimed is:

1. A tape printing apparatus comprising: a cassette housing portion that replaceably houses a tape cassette; a tape conveying unit for conveying a tape that is long and accommodated inside-4n-the tape cassette; a printing unit for carrying out printing on the tape; and a cutter unit that cuts off a tape, wherein the tape printing apparatus further comprises:

a printing-information obtaining unit that obtains printing information consisting of printing data to be printed out on the tape and a created number of labels to be printed by on the tape;

a type detecting unit that detects a type of a tape cassette housed in the cassette housing portion;

a type identifying unit that identifies whether or not the type of the tape cassette detected by the type detecting unit is a stripped-tape accommodating cassette which is a cassette that accommodates a film tape and a two sided adhesive tape including two adhesive layers, one of which is covered with a separator and the other of which is free from the separator, the separator being removed from the two sided adhesive tape, within the cassette, after an adhesive layer, free from the separator, and a printed surface of the film tape are pasted together by the tape conveying unit; and a printing control unit that controls the printing unit to print out the printing data only once, thereafter convey the tape to a cutting point for the cutter unit and stop conveyance of the tape so as to terminate printing, if the type of the tape cassette housed in the cassette housing portion is identified as the stripped-tape accommodating cassette.

2. The tape printing apparatus according to claim 1, wherein the printing control unit controls the cutter unit to cut off a tape after stopping conveyance of the tape.

3. The tape printing apparatus according to claim 1, wherein the printing control unit controls the printing unit to successively print out the printing data included in the printing information as many times as the number of labels to be printed and convey the tape to the cutting point for the cutter unit so as to cut off and create each label if the type of the tape cassette housed in the cassette housing portion is identified as a non-stripped tape accommodating cassette.

4. The tape printing apparatus according to claim 1 further comprising an informing unit that provides printing information wherein if the type of tape cassette housed in the cassette housing portion is identified as a stripped-tape cassette, the printing control unit determines if the number of labels to be printed is greater than one and, if so, controls the informing unit to inform that the printing data will be printed out only once.

* * * * *